US006605419B2

(12) United States Patent
Simons

(10) Patent No.: US 6,605,419 B2
(45) Date of Patent: Aug. 12, 2003

(54) METHOD AND MATERIAL FOR PHOTOGRAPHIC PROCESSING

(75) Inventor: Michael J. Simons, Ruislip (GB)

(73) Assignee: Eastman Kodak Company, Rochester, NY (US)

( * ) Notice: Subject to any disclaimer, the term of this patent is extended or adjusted under 35 U.S.C. 154(b) by 0 days.

(21) Appl. No.: 10/134,743

(22) Filed: Apr. 29, 2002

(65) Prior Publication Data

US 2002/0192605 A1 Dec. 19, 2002

(30) Foreign Application Priority Data

May 30, 2001 (GB) ..... 0113023

(51) Int. Cl.[7] ..... G03C 5/39; G03C 7/42
(52) U.S. Cl. ..... 430/403; 430/429; 430/458
(58) Field of Search ..... 430/403, 429, 430/458

(56) References Cited

U.S. PATENT DOCUMENTS 3,236,650 A 2/1966 Limberger ..... 430/352

FOREIGN PATENT DOCUMENTS

| | | |
|---|---|---|
| EP | 1 164 416 A2 | 12/2001 |
| GB | 1121277 | 7/1965 |
| GB | 1155948 | 6/1966 |
| WO | 93/12462 | 6/1993 |

*Primary Examiner*—Hoa Van Le

(57) ABSTRACT

A method of providing an image in an imagewise exposed silver halide photographic silver material comprising at least one silver halide emulsion layer, comprises developing the silver halide and fixing the remaining silver halide by (i) contacting the photographic material with a composition comprising a solid complexing agent for the silver halide in the presence of a sufficient amount of water to transfer complexing agent to the surface of the photographic material and (ii) applying heat to cause the complexing agent to react with the silver halide to render it substantially clear.

7 Claims, No Drawings

METHOD AND MATERIAL FOR PHOTOGRAPHIC PROCESSING

FIELD OF THE INVENTION

The invention relates to a method and material for photographic processing.

BACKGROUND OF THE INVENTION

The basic image-forming process of photography comprises the exposure of a silver halide photographic recording material, such as a color film, to electromagnetic radiation, and the chemical processing of the exposed material to provide a useful image. Chemical processing involves two fundamental steps. The first is treatment of the exposed silver halide material with a developing agent wherein some or all of the silver ion is reduced to metallic silver, and in the case of color materials, a dye image is formed (because of a color developing agent).

For color materials, a second fundamental step is the removal of silver metal by one or more steps of bleaching and fixing so that only a dye image remains in the processed material. During bleaching, the developed silver is oxidized to a silver salt by a suitable bleaching agent. The oxidized silver is then dissolved and removed from the material using a fixing agent or silver solvent in a fixing step. In the case of a film that is to be scanned, however, the bleach stage may be omitted. In the case of black-and-white materials, the fixing step is only to remove silver halide.

Additional photoprocessing steps may be needed including rinsing or dye stabilization that require even more photoprocessing chemicals. In the case of color reversal materials, additional photoprocessing steps include black-and-white development, a reversal step, pre-bleaching or conditioning step and one or more rinsing steps.

All of these photoprocessing steps require preparation of the photoprocessing compositions (whether in aqueous or solid form), large or small photoprocessing tanks or reservoirs to hold the compositions, and disposal or regeneration of the "spent" compositions once a predetermined amount of exposed material has been processed. All of these operations require considerable manufacturing effort, shipping and handling of chemicals and aqueous solutions, replenishment of the solutions, and disposal of solutions into the environment.

These characteristics of conventional photoprocessing are labor intensive, tedious, costly and potentially harmful to the environment (although much work has been accomplished in the industry to make the compositions more environmentally "friendly"). Recent digital technologies in the photographic industry offer advantages in that they can enable the user to manipulate the images after photochemical processing by scanning to create a digital representation of the image. One of these advantages is the ability to readjust the exposure by automatic tone scaling to correct for either over or underexposure. Other uses of digitization are to crop, enlarge or otherwise modify the image, or to send the image to other users electronically for various purposes. The growing awareness of digitization of photographic images provides almost limitless possibilities for image manipulation for various purposes in a number of industries.

Our copending UK Patent application No 0014422.0 describes a method of providing an image in an imagewise exposed photographic silver halide material comprising at least one silver halide emulsion layer which method comprises developing the silver halide and fixing the remaining silver halide by contacting it with a molten composition comprising a silver halide complexing agent which is present in sufficient amount to render the silver halide substantially clear. The method is carried out under substantially dry conditions that is without water having to be provided in addition to the fixing agent and unlike conventional fixing there is no requirement for the silver halide complex formed to be removed from the emulsion layer.

PROBLEM TO BE SOLVED BY THE INVENTION

There is a continuing need to reduce the number of stages in the overall photographic development process. The present invention provides a process which enables the wash stage that conventionally follows the fixing stage to be eliminated by contacting the photographic material with a solid complexing agent for the silver halide to transfer complexing agent to the photographic material and, by the application of heat, causing the complexing agent react with the silver halide.

SUMMARY OF THE INVENTION

The present invention comprises a method of providing an image in an imagewise exposed photographic silver halide material comprising at least one silver halide emulsion layer, the method comprising developing the silver halide and fixing the remaining silver halide by (i) contacting the photographic material with a composition comprising a solid complexing agent for the silver halide in the presence of a sufficient amount of water to transfer complexing agent to the surface of the emulsion layer and (ii) applying heat to cause the complexing agent to react with the silver halide to render it substantially clear.

ADVANTAGEOUS EFFECT OF THE INVENTION

The invention provides a process in which the wash stage that conventionally follows the fixing stage can be eliminated and replaces the conventional liquid fixing bath with a solid composition containing complexing agent.

The heat applied to effect the reaction between the complexing agent and the silver halide may also be employed to effect drying of the photographic material.

DETAILED DESCRIPTION OF THE INVENTION

The term fixing in the present specification is intended to include clearing. The transfer of the composition containing the complexing agent to the photographic material may be effected by a wiping action, that is, by a sliding contact between the two.

The term wiping is intended to include rubbing.

Water is present to facilitate the transfer and it is preferred that the surface of the solid complexing agent-containing composition is smooth. It is preferred that large amounts of water are not present and conveniently the photographic material after leaving the preceding bath (which will usually be awash) will be contacted by a squeegee or similar means to remove excess free water.

Preferably, the silver halide photographic material and the transferred silver halide complexing agent composition are heated to a temperature in the range from 40 to 170° C., more preferably from 70 to 150° C. Preferably the silver halide complexing agent-containing composition has melting point within the given temperature ranges.

It is convenient to heat the photographic material and transferred complexing agent to a temperature above the melting point of the complexing agent-containing composition.

It is not essential however to melt the complexing agent composition. For example imidazole having a melting point of 89 to 91 degrees C is effective in the present invention when heated to 82 degrees C.

If the complexing agent composition is heated to a temperature which is below its melting point, it is preferred that the temperature is not lower than about 20 degrees Centigrade below the melting point, more preferably not lower than 10 degrees below the melting point of the complexing agent containing composition.

The silver complexing agent may be a heterocyclic amine.

Preferably, the heterocyclic amine is a substituted or unsubstituted imidazole, pyrazole or triazole.

Particularly preferred silver complexing agents include imidazole and alkyl substituted imidazoles e.g. 2-methyl imidazole, 4-methyl imidazole, and 1,2-dimethyl imidazole.

Examples of other suitable heterocyclic amine silver complexing agents include benzimidazole; 1,2,4-triazole and substituted 1,2,4-triazoles e.g. 4-amino-1,2,4-triazole, 3-amino-1,2,4-triazole and 1,2,4-triazole-3-thiol; pyrazole; and 1-(hydroxyethyl)-tetrahydrotriazine-4-thiol.

The silver complexing agents may be used with a compound which co-melts with the complexing agent to provide a molten mixture in the desired temperature range. Examples of compounds which may be suitable as co-melters for the organic complexing agents listed above include amides such as benzamide (m.pt. 129° C.), p-toluamide (m.pt. 162° C.), anthranilamide (m.pt. 113° C.), salicylamide (m.pt. 142° C.), nicotinamide (m.pt. 131° C.), ureas such as 1,3-dimethylurea (m.pt. 102° C.) and n-butylurea (m.pt. 94° C.), and other compounds such as antipyrine (m.pt. 112° C.), coumarin (m.pt. 71° C.), cyclohexane-1,4-diol (m.pt. 99° C.), p-acetophenetitide (m.pt. 136° C.), succinimide (m.pt. 125° C.), and polyethylene glycols (various melting points, depending on molecular weight). The amount of silver complexing agent that may be transferred to the silver halide emulsion may be such that it is present in the emulsion in an amount from 2 to 200 $g/m^2$, preferably from 5 to 75 $g/m^2$.

It is advantageous for the silver halide complexing agent to render the silver halide substantially clear in a short a time period as possible. Preferred complexing agents have a clearing effect in 60seconds (s) or less, most preferably 30 s or less.

Polymeric binders may be used to improve the physical stability of the solid composition containing the silver halide complexing agent.

Suitable polymeric binders include high molecular weight materials and resins such as poly(vinyl butyral), cellulose acetate, poly(methylmethacrylate), poly(vinylpyrrolidone), ethyl cellulose, polyvinyl acetate and polyvinylpyridines. Water-soluble resins and polymers which may be used include, gelatin, poly(vinyl alcohol), polyacrylamide, polyethylene glycols, polyethylene oxide, hydroxyethylcellulose, hydroxypropylcellulose, carboxymethylcellulose, polyacrylic acid, and naturally occurring materials such as gum Arabic.

According to another aspect of the present invention there is provided a composition in the form of a solid black said composition comprising a silver halide complexing agent, preferably an organic heterocyclic amine, and an organic polymeric binder in an amount to improve the physical stability of the solid composition.

Preferably the block has a curved surface which is conveniently cylindrical to facilitate transfer of complexing agent to the emulsion layer of a silver halide photographic material by sliding contact between the solid block and the photographic material.

The solid block of complexing agent and polymeric binder may conveniently be prepared by a method in which the polymeric binder is dissolved in the molten silver complexing agent e.g. imidazole at a temperature above its melting point and the molten composition is cast into a block of suitable shape, desirably having a smooth curved surface, conveniently cylindrical.

The imidazole silver complexing agents noted above are mildly basic and it may be desirable to use them in combination with acid substances to reduce the basicity. Suitable acid substances include succinic acid, citric acid, benzoic acid and salicylic acid.

It may also be desirable to use development restrainers in combination with the silver complexing agent to prevent physical development of the silver complex formed. Suitable development restrainers include simple bromides e.g. ammonium bromide and lithium bromide, which are soluble in non-aqueous solvents, and also organic restrainers e.g. benzotriazoles, 3-mercaptotriazoles and phenyl mercaptotetrazoles.

The method and material of the invention may be used in any form of photographic system e.g. color or black and white. In a preferred embodiment of the invention the photographic material used is a color negative film. Prints can be made from the film by conventional optical techniques or by scanning the film and printing using a laser, light emitting diode or a cathode ray tube.

A color negative film construction useful in the practice of the invention is illustrated by the following element, SCN-1:

| Element SCN-1 | |
|---|---|
| Soc | Surface Overcoat |
| BU | Blue Recording Layer Unit |
| IL1 | First Interlayer |
| GU | Green Recording Layer Unit |
| IL2 | Second Interlayer |
| RU | Red Recording Layer Unit |
| AHU | Antihalation Layer Unit |
| S | Support |
| SOC | Surface Overcoat |

The support S can be either reflective or transparent, which is usually preferred. When reflective, the support is white and can take the form of any conventional support currently employed in color print elements. When the support is transparent, it can be colorless or tinted and can take the form of any conventional support currently employed in color negative elements—e.g., a colorless or tinted transparent film support. Details of support construction are well understood in the art. Examples of useful supports are poly(vinylacetal) film, polystyrene film, poly (ethyleneterephthalate) film, poly(ethylene naphthalate) film, polycarbonate film, and related films and resinous materials, as well as paper, cloth, glass, metal, and other supports that withstand the anticipated processing conditions. The element can contain additional layers, such as filter layers, interlayers, overcoat layers, subbing layers, antihalation layers and the like. Transparent and reflective support constructions, including subbing layers to enhance adhesion, are disclosed in Section XV of *Research* Disclosure, September 1996, No. 389, Item 38957, hereinafter referred to as *Research Disclosure I.*

Each of blue, green and red recording layer units BU, GU and RU are formed of one or more hydrophilic colloid layers and contain at least one radiation-sensitive silver halide emulsion and coupler, including at least one dye image-forming coupler. It is preferred that the green, and red recording units are subdivided into at least two recording layer sub-units to provide increased recording latitude and reduced image granularity. In the simplest contemplated construction each of the layer units or layer sub-units consists of a single hydrophilic colloid layer containing emulsion and coupler. When coupler present in a layer unit or layer sub-unit is coated in a hydrophilic colloid layer other than an emulsion containing layer, the coupler containing hydrophilic colloid layer is positioned to receive oxidized color developing agent from the emulsion during development. Usually the coupler containing layer is the next adjacent hydrophilic colloid layer to the emulsion containing layer.

In order to ensure excellent image sharpness, and to facilitate manufacture and use in cameras, all of the sensitized layers are preferably positioned on a common face of the support. When in spool form, the element will be spooled such that when unspooled in a camera, exposing light strikes all of the sensitized layers before striking the face of the support carrying these layers. Further, to ensure excellent sharpness of images exposed onto the element, the total thickness of the layer units above the support should be controlled. Generally, the total thickness of the sensitized layers, interlayers and protective layers on the exposure face of the support are less than 35 $\mu$m.

Any convenient selection from among conventional radiation-sensitive silver halide emulsions can be incorporated within the layer units. Most commonly high bromide emulsions containing a minor amount of iodide are employed. To realize higher rates of processing, high chloride emulsions can be employed. Radiation-sensitive silver chloride, silver bromide, silver iodobromide, silver iodochloride, silver chlorobromide, silver bromochloride, silver iodochlorobromide and silver iodobromochloride grains are all contemplated. The grains can be either regular or irregular (e.g., tabular). Tabular grain emulsions, those in which tabular grains account for at least 50 (preferably at least 70 and optimally at least 90) percent of total grain projected area are particularly advantageous for increasing speed in relation to granularity. To be considered tabular a grain requires two major parallel faces with a ratio of its equivalent circular diameter (ECD) to its thickness of at least 2. Specifically preferred tabular grain emulsions are those having a tabular grain average aspect ratio of at least 5 and, optimally, greater than 8. Preferred mean tabular grain thicknesses are less than 0.3 $\mu$m (most preferably less than 0.2 $\mu$m). Ultrathin tabular grain emulsions, those with mean tabular grain thicknesses of less than 0.07 $\mu$m, are specifically contemplated. The grains preferably form surface latent images so that they produce negative images when processed in a surface developer in color negative film forms of the invention.

Illustrations of conventional radiation-sensitive silver halide emulsions are provided by *Research Disclosure I,* cited above, I. Emulsion grains and their preparation. Chemical sensitization of the emulsions, which can take any conventional form, is illustrated in section IV. Chemical sensitization. Compounds useful as chemical sensitizers, include, for example, active gelatin, sulfur, selenium, tellurium, gold, platinum, palladium, iridium, osmium, rhenium, phosphorous, or combinations thereof. Chemical sensitization is generally carried out at pAg levels of from 5 to 10, pH levels of from 4 to 8, and temperatures of from 30 to 80° C. Spectral sensitization and sensitizing dyes, which can take any conventional form, are illustrated by section V. Spectral sensitization and desensitization. The dye may be added to an emulsion of the silver halide grains and a hydrophilic colloid at any time prior to (e.g., during or after chemical sensitization) or simultaneous with the coating of the emulsion on a photographic element. The dyes may, for example, be added as a solution in water or an alcohol or as a dispersion of solid particles. The emulsion layers also typically include one or more antifoggants or stabilizers, which can take any conventional form, as illustrated by section VII. Antifoggants and stabilizers.

The silver halide grains to be used in the invention may be prepared according to methods known in the art, such as those described in *Research Disclosure I,* cited above, and James, The Theory of the Photographic Process. These include methods such as ammoniacal emulsion making, neutral or acidic emulsion making, and others known in the art. These methods generally involve mixing a water soluble silver salt with a water soluble halide salt in the presence of a protective colloid, and controlling the temperature, pAg, pH values, etc, at suitable values during formation of the silver halide by precipitation.

Instead of employing dye-forming couplers, any of the conventional incorporated dye image generating compounds employed in multicolour imaging can be alternatively incorporated in the blue, green and red recording layer units. Dye images can be produced by the selective destruction, formation or physical removal of dyes as a function of exposure.

It is also well known that pre-formed image dyes can be incorporated in blue, green and red recording layer units, the dyes being chosen to be initially immobile, but capable of releasing the dye chromophore in a mobile moiety as a function of entering into a redox reaction with oxidized developing agent. These compounds are commonly referred to as redox dye releasers (RDR's). By washing out the released mobile dyes, a retained dye image is created that can be scanned. It is also possible to transfer the released mobile dyes to a receiver, where they are immobilized in a mordant layer. The image-bearing receiver can then be scanned. Initially the receiver is an integral part of the color negative element. When scanning is conducted with the receiver remaining an integral part of the element, the receiver typically contains a transparent support, the dye image bearing mordant layer just beneath the support, and a white reflective layer just beneath the mordant layer. Where the receiver is peeled from the color negative element to facilitate scanning of the dye image, the receiver support can be reflective, as is commonly the choice when the dye image is intended to be viewed, or transparent, which allows transmission scanning of the dye image. RDR's as well as dye image transfer systems in which they are incorporated are described in *Research Disclosure,* Vol. 151, November 1976, Item 15162.

It is also recognized that the dye image can be provided by compounds that are initially mobile, but are rendered immobile during imagewise development. Image transfer systems utilizing imaging dyes of this type have long been used in previously disclosed dye image transfer systems. These and other image transfer systems compatible with the practice of the invention are disclosed in *Research*

*Disclosure,* Vol. 176, December 1978, Item 17643, XXIII Image transfer systems. A number of modifications of color negative elements have been suggested for accommodating scanning, as illustrated by *Research Disclosure I,* Section XIV. Scan facilitating features. These systems to the extent compatible with the color negative element constructions described above are contemplated for use in the practice of this invention.

It is also contemplated that the imaging element of this invention may be used with non-conventional sensitization schemes. For example, instead of using imaging layers sensitized to the red, green, and blue regions of the spectrum, the light-sensitive material may have one white-sensitive layer to record scene luminance, and two color-sensitive layers to record scene chrominance. Following development, the resulting image can be scanned and digitally reprocessed to reconstruct the fall colors of the original scene as described in U.S. Pat. No. 5,962,205. The imaging element may also comprise a pan-sensitized emulsion with accompanying color-separation exposure. In this embodiment, the developers of the invention would give rise to a colored or neutral image that, in conjunction with the separation exposure, would enable full recovery of the original scene color values. In such an element, the image may be formed by either developed silver density, a combination of one or more conventional couplers, or "black" couplers such as resorcinol couplers. The separation exposure may be made either sequentially through appropriate filters, or simultaneously through a system of spatially discreet filter elements (commonly called a "color filter array").

The imaging element may also be a black and white image-forming material comprised, for example, of a pan-sensitized silver halide emulsion and a developer of the invention. In this embodiment, the image may be formed by developed silver density following processing, or by a coupler that generates a dye which can be used to carry the neutral image tone scale.

In accordance with another aspect of this invention, the solid complexing agent used in the invention is incorporated in or used in combination with a photographic element in the context of low volume aqueous processing in combination with the application of heat. Low volume processing is defined as processing where the volume of applied developer solution is between about 0.1 to about 10 times, preferably about 0.5 to about 10 times, the volume of solution required to swell the photographic element. The processing may take place by a combination of solution application, external layer lamination and heating.

In addition, it is specifically contemplated that any components described in the preceding sections that are not necessary for the formation or stability of latent image in the origination film element can be removed from the film element altogether and contacted at any time after exposure for the purpose of carrying out photographic processing, using the methods described below. According to this process, the photographic element may receive some or all of the following treatments:

(I) Application of a solution directly to the film by any means, including spray, inkjet, coating and gravure process.

(II) Soaking of the film in a reservoir containing a processing solution. This process may also take the form of dipping or passing an element through a small cartridge.

I. Heating of the element by any convenient means, including a simple hot plate, iron, roller, heated drum, microwave heating means, heated air, vapor, or the like. Heating may be accomplished before, during, after, or throughout any of the preceding treatments I–II. Processing temperatures ranging from room temperature to above 100° C. may be used.

Conventional photographic elements can be processed in any of a number of well-known photographic processes utilizing any of a number of well-known conventional photographic processing solutions, described, for example, in *Research Disclosure I,* or in T. H. James, editor, *The Theory of the Photographic Process,* $4^{th}$ Edition, Macmillan, New York, 1977. The development process may take place for any length of time and any process temperature that is suitable to render an acceptable image. In the case of processing a negative working color element, the element is treated with a color developer (that is one which will form the colored image dyes with the color couplers), and then optionally with an oxidizer to oxidize metallic silver to silver salt. In the case of processing a reversal color element, the element isfirst treated with a black and white developer (that is, a developer which does not form colored dyes with the coupler compounds) followed by a treatment to fog silver halide (usually chemical fogging or light fogging), followed by treatment with a color developer. Preferred color developing agents are p-phenylenediamines. Especially preferred are:

4-amino N,N-diethylaniline hydrochloride, 4-amino-3-methyl-N,N-diethylaniline hydrochloride, 4-amino-3-methyl-N-ethyl-N-(2-(methanesulfonamido) ethylaniline esquisulfate hydrate, 4-amino-3-methyl-N-ethyl-N-(2-hydroxyethyl)aniline sulfate, 4-amino-3-β-(methanesulfonamido)ethyl-N,N-diethylaniline hydrochloride and 4-amino-N-ethyl-N-(2-methoxyethyl)-m-toluidine di-p-toluene sulfonic acid.

The invention is further illustrated by way of example as follows.

EXAMPLE 1

A cylindrical block of solid imidazole was prepared by melting imidazole powder in a cylindrical vessel of 3 cm internal diameter, allowing the imidazole to cool and solidify, then removing the vessel from around the solid block.

A length of Kodacolor (Kodacolor is a Registered Trade Mark) Royal Gold 400 colour negative film was exposed to a coloured test object. The film was developed for 3.25 minutes at 38C in C41 developer solution, then put in a stop bath for 15 s then rinsed with water. Surplus surface water was removed by a squeegee and the swollen film surface pulled into contact with the cylinder of imidazole and pulled to and fro for 20 s. The film was then held, emulsion side up, against a curved metal block maintained at 100C. After 30 s it was seen that the film had dried and had become clear or fixed, revealing a coloured image against a clear background.

EXAMPLE 2

A piece of photographic film which comprised a 70:30 silver chlorobromide emulsion having 0.32 micron edge length cubic grains coated at 4.4 g/m2 of silver was soaked in water for 20 seconds. It was then contacted against the imidazole block prepared as described in Example 1 for 3 seconds and held face up for 10 seconds on the curved metal block maintained at 100C. The coating had become completely clear in the areas that had been treated.

EXAMPLE 3

A cylinder of solid fixing or clearing agent composition was prepared by melting together, in a tube of 1.5 cm internal diameter, 6.0 g of imidazole and 1.0 g of hydroxyethyl cellulose ("Natrosol" type 250GR, supplied by Aqualon). A clear, viscous solution resulted, which was allowed to cool and solidify around a metal spindle that was inserted axially in the tube. The tube was briefly re-heated in the steam bath to melt the outermost layer and allow a cylinder of solid fixing or clearing agent composition to be withdrawn from the tube by pulling on the metal spindle.

The experiment of Example 2, using the film of Example 2, was repeated, but using the cylinder of solid fixing or clearing agent composition of the present Example.

The film became clear in the treated areas, and showed a much reduced tendency to form surface crystals of imidazole on cooling.

The invention has been described in detail with particular reference to certain preferred embodiments thereof, but it will be understood that variations and modifications can be effected within the spirit and scope of the invention.

What is claimed is:

1. A method of providing an image in an imagewise exposed photographic silver halide material comprising at least one silver halide emulsion layer, the method comprising developing the silver halide and fixing the remaining silver halide by (i) contacting the photographic material with a composition comprising a solid complexing agent for the silver halide in the presence of a sufficient amount of water to transfer complexing agent-containing composition to the surface of the emulsion layer and (ii) applying heat to cause the complexing agent to react with the silver halide to render it substantially clear.

2. A method as claimed in claim 1 wherein the photographic material and transferred complexing agent-containing composition are heated to a temperature in the range from 40 to 170° C.

3. A method as claimed in claim 1 wherein composition comprising the solid silver halide complexing agent is in the form of a solid block.

4. A method as claimed in claim 1 wherein the complexing agent-containing composition is transferred to the photographic material by a wiping action.

5. A method as claimed in claim 1 wherein the silver complexing agent is a heterocyclic amine.

6. A method as claimed in claim 5 wherein the heterocyclic amine is a substituted or unsubstituted imidazole, pyrazole or triazole.

7. A method as claimed in claim 1 wherein the composition comprising the silver halide complexing agent contains a polymeric binder.

* * * * *